US009545348B2

(12) United States Patent
Britton

(10) Patent No.: US 9,545,348 B2
(45) Date of Patent: Jan. 17, 2017

(54) MATTRESS WITH A ROTATING AND WASTE ELIMINATION SYSTEM

(71) Applicant: Elaine L. Britton, Valhalla, NY (US)

(72) Inventor: Elaine L. Britton, Valhalla, NY (US)

( * ) Notice: Subject to any disclaimer, the term of this patent is extended or adjusted under 35 U.S.C. 154(b) by 136 days.

(21) Appl. No.: 14/330,006

(22) Filed: Jul. 14, 2014

(65) Prior Publication Data

US 2016/0008196 A1 Jan. 14, 2016

(51) Int. Cl.

| | |
|---|---|
| ***A61G 7/02*** | (2006.01) |
| ***A61G 7/10*** | (2006.01) |
| ***A61G 7/057*** | (2006.01) |
| ***A61G 9/00*** | (2006.01) |

(52) U.S. Cl.

CPC ..... *A61G 7/02* (2013.01); *A61G 7/057* (2013.01); *A61G 7/109* (2013.01); *A61G 7/1015* (2013.01); *A61G 7/1019* (2013.01); *A61G 9/003* (2013.01)

(58) Field of Classification Search

CPC ..... A61G 7/02; A61G 7/1015; A61G 7/008; A61G 7/018; A61G 9/003; A61G 7/1019; A61G 7/109; A61G 7/057

See application file for complete search history.

(56) References Cited

U.S. PATENT DOCUMENTS 3,099,842 A * 8/1963 Jensen ..... A61G 7/1009 5/84.1
3,772,712 A * 11/1973 Renn ..... A47K 11/02 4/484
3,849,811 A * 11/1974 Cyll ..... A61G 7/02 4/451
3,959,832 A * 6/1976 Parsons ..... A61G 1/04 5/84.1
4,222,133 A * 9/1980 Csatary ..... A61G 7/1055 4/450
4,368,733 A * 1/1983 Sanidas ..... A61B 10/0038 604/327
4,620,333 A * 11/1986 Ritter ..... A61G 7/02 5/604
4,843,665 A * 7/1989 Cockel ..... A61G 7/0005 5/81.1 R
4,847,932 A * 7/1989 Baribault, Jr. ..... A61G 7/02 4/452

(Continued)

*Primary Examiner* — David E Sosnowski
*Assistant Examiner* — Myles Throop
(74) *Attorney, Agent, or Firm* — R. Neil Sudol; Henry D. Coleman

(57) ABSTRACT

A mattress with a rotating and waste elimination system comprises a mattress with a recessed area for receiving a rotation and waste elimination system. The rotation and waste elimination system comprises a (i) frame with a rectangular base and two side walls, forming a "U" shape; (ii) platform (with a central cut out for a waste elimination bag) suspended over the base by two pairs of sliding posts; (iii) optional four chains attached to the platform and side walls; and (iv) programmable electronic gear to operate the sliding posts to simultaneously raise one end and lower the opposite end of the platform to gently turn the patient. Alternately, the gear operates a cable/pulley system (involving two independent systems positioned outside the frame) by attaching one cable end to the midpoint of the platform's shorter side and the other cable end to the gear to rotate and counter-rotate the platform.

17 Claims, 12 Drawing Sheets

(56) References Cited

U.S. PATENT DOCUMENTS

| | | | | |
|---|---|---|---|---|
| 5,265,296 | A * | 11/1993 | Abbas | A61G 7/02 5/488 |
| 5,539,941 | A * | 7/1996 | Fuller | A61G 7/0005 5/85.1 |
| 6,295,666 | B1 * | 10/2001 | Takaura | A61G 7/001 5/611 |
| 6,931,684 | B1 * | 8/2005 | Henegar | A61G 7/02 5/604 |
| 9,084,703 | B1 * | 7/2015 | Fair | A61G 7/02 |
| 2010/0101023 | A1 * | 4/2010 | Stephens | A61G 9/003 5/604 |
| 2013/0000041 | A1 * | 1/2013 | Receveur | A61G 7/0573 5/618 |
| 2013/0086737 | A1 * | 4/2013 | Bizar | A47K 11/02 4/484 |
| 2014/0310875 | A1 * | 10/2014 | Iida | A61G 1/01 5/606 |
| 2016/0101007 | A1 * | 4/2016 | Onoda | A61F 5/451 604/326 |

* cited by examiner

MATTRESS WITH A ROTATING AND WASTE ELIMINATION SYSTEM

BACKGROUND OF THE INVENTION

Field of the Invention

The present invention relates to a lateral rotation medical device and more particularly to a mattress with a lateral rotation device and waste elimination system.

Description of Related Art

Currently, there are rotating mattresses on the market for approximately $4,000 to $30,000, but they do not provide for elimination of wastes. Medicaid currently requires nurses' aides in nursing homes to attend to 10 patients per shift. However, an incontinent patient with a severe waste problem may require 2 aides to rotate and clean them, using 2-5 towels, in addition to 1-4 sheets, and can take up to ½ hour. If all 10 patients require such attention, this would fill 5 hours of an aide's 8 hour shift. As a result, due to the physical effort of lifting heavy patients and the time involved, aides are not able to fully address the problem and many patients in nursing homes sit in their waste for up to 3-4 hours. Ultimately, the waste permeates and infects, or further exacerbates bedsores located near patients' lower spines. This common occurrence does not allow patients' bedsores to heal and is extremely inhumane.

Therefore, there is a need for a cost-effective mattress medical device that allows for ease of rotating a bedridden patient and effectuating the disposal of the patient's waste, to prevent and treat bedsores.

SUMMARY OF THE INVENTION

Objectives of the invention are to allow for ease of (i) rotation and (ii) waste disposal of bedridden patients to prevent and treat bedsores.

Another object of the invention is to provide for a more cost effective, economically feasible rotation and waste disposal mattress system for bedridden patients for low-income nursing homes and in-home caretakers.

In an exemplary embodiment of the present invention, there is disclosed a mattress with a rotating and waste elimination system comprising a rotating/waste elimination system that rests in the recessed area of a mattress, either a conventional or alternating pressure mattress. The system has a frame with a rectangular base and two lateral side walls forming a "U" shape, a platform with its interior cut out for inserting a plastic bag for waste elimination, suspended over the base by two pairs of sliding posts, the top part of each individual post is connected to the bottom of the platform and the bottom part of each post is connected to the top sides of the rectangular base, optional four chains that attach to the platform on each chain's first end and to the side walls, and an electronic lift system which has a programmable electronically-controlled gear that operates the posts to cause one pair of posts to raise one end and simultaneously causes the second pair of posts to lower the opposite end of the platform to gently turn the patient.

In the alternative, the platform is suspended over the base by the four chains and is rotated by two electronic pulley systems each with one end of the cable attached to the midpoint of each shorter side of the platform and the second end of the cable attached to a programmable electronically-controlled gear that rotates and counter-rotates to pull or release the cable and, in turn, pull on or release the platform.

In addition to the pelvic area, the device may also be used for prevention/treatment of bed sores around the head and shoulder areas, in which case two devices may be placed between custom sections of mattresses according to the needs/size of the patient.

The more important features of the invention have thus been outlined in order that the more detailed description that follows may be better understood and the contribution to the art may better be appreciated. Additional features of the invention will be described hereafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form. As such, wherein a cable pulley system or wherein an electronic lift system is discussed the two systems can be interchanged into this device leading to the same functionality but for a variation of cost associated with production of the device itself.

BRIEF DESCRIPTION OF THE DRAWINGS

Other aspects, features, and advantages of the present invention will become more fully apparent from the following detailed description, the appended claims, and the accompanying drawings in which similar elements are given similar reference numerals.

DESCRIPTION OF THE PREFERRED EMBODIMENT

Listed below is a table that shows the description, related number and within which figures said feature appears.

| DESCRIPTION | NUMBER. | FIGURE NUMBERS. |
|---|---|---|
| Mattress | 1 | 1A, 2, 3, 6, 9, 10 |
| Recessed portion of Mattress | 2 | 1A, 2, 3, 4, 5, 6, 9, 10 |
| Platform | 25 | 1A, 2, 5, 6, 7, 9, 10 |
| Chains | 26 | 1A, 2, 6, 7, 10 |
| Mini-alternating air mattresses | 27 | 1A, 2, 6 |
| Cable or Belt for pulley system | 28 | 2, 6, 10 |
| Electronic pulley system | 29 | 2, 6, 10 |
| Chain hook and loop | 30 | 1A, 2, 6, 10 |
| Plastic bag for waste elimination | 31 | 5, 8 |
| Fabric hooks on top 2" of outside of waste collection bag | 32 | 8 |
| Fabric hooks located on bottom of platform | 33 | 7 |
| Cut-out portion of platform | 34 | 1A, 2, 6, 7, 9, 10 |
| Frame | 50 | 1A, 2, 5 |
| Rectangular Base | 51 | 1A, 2, 5, 9, 10 |
| Two Side Walls | 52 | 1A, 2, 5, 6 |
| Rotating and waste elimination system | 100 | 1A, 1B, 1C, 2, 6 |
| Electronic Lift System | 200 | 1A, 1B, 1C |
| Two pairs of posts | 202 | 1A, 1B, 9 |
| Programmable electronically-controlled gear | 203 | 1A, 1B, 1C, 9 |
| Top of Rectangular Base | 204 | 1B, 1C |

Figure 1A:
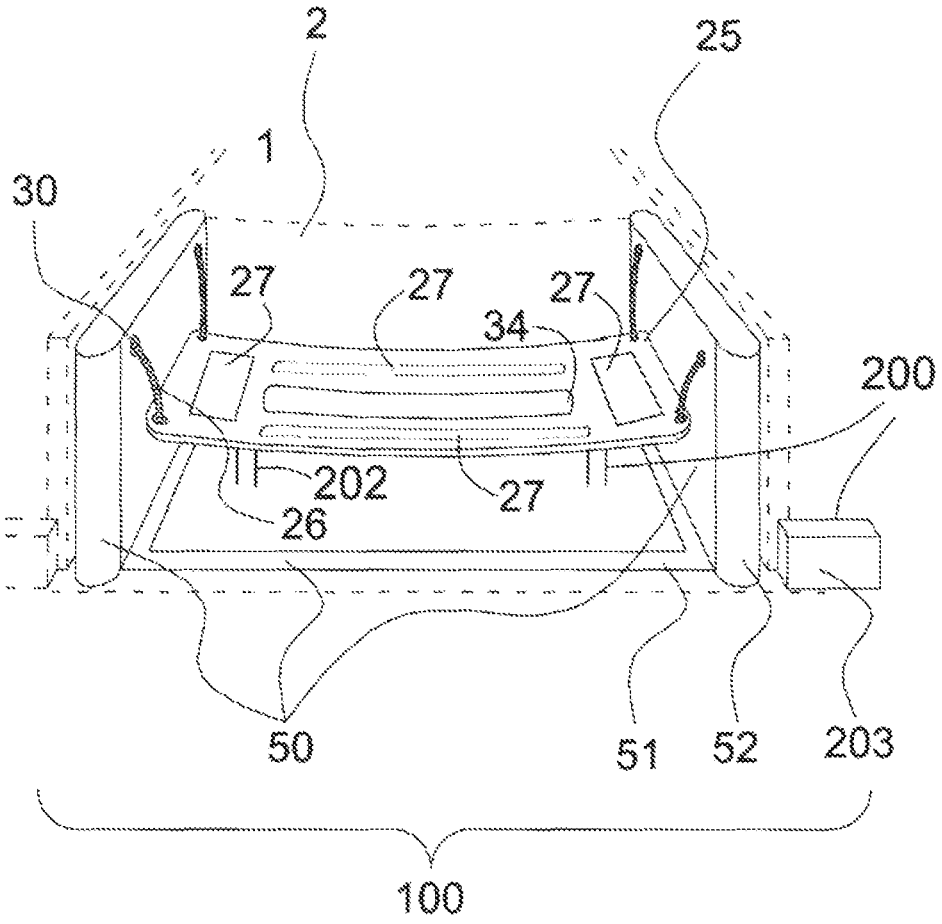
FIG. 1A is a perspective top view of the medical device showing the electronic lift system placed into the recess of the mattress.

Referring to FIG. 1A, the rotating and waste elimination system 100 which is to be placed into a mattress 1 with a recessed area 2 comprises three parts: 1) a frame 50, 2) a platform 25 and 3) an electronic lift system 200.

The frame 50 has a rectangular base 51 that has four sides with the dimensions being approximately 36" long edges, 12" short edges, and has a central rectangular shaped cut out having two long edges of approximately 32 inches and two short edges of approximately 8 inches. Additionally, the frame 50 has two side walls 52 of approximately 24 inches height having an interior side, an exterior side, a top side, a bottom side, two lateral sides with the bottom side perpendicularly attached to the 12" shorter edges of the rectangular base 51.

The platform 25 has a top side, a bottom side forming a four-sided rectangular shape therein with a dimension that has approximately 36" longer sides, 12" shorter sides, and a central cut out 34 having two long sides of approximately 32 inches and two short sides of approximately 8 inches. The platform 25 is supported by two pairs of sliding posts 202 and is positioned parallel above the base 51 and between the two 24" side walls 52, having one end of optional two chains 26 attached to each of the 12" shorter sides through a chain hook and loop 30 on the corners and the other end of the optional two chains 26 attached to each interior sides of the walls 52 near the top side through another set of chain hook and loops 30. The platform 25 is lined with additional mini-alternating air mattresses 27 all connected to the main alternating air mattress 1. Additionally, the platform 25 has a plurality of fabric loops such as Velcro™ or similar styled material loops located on the bottom side.

Figure 1B:
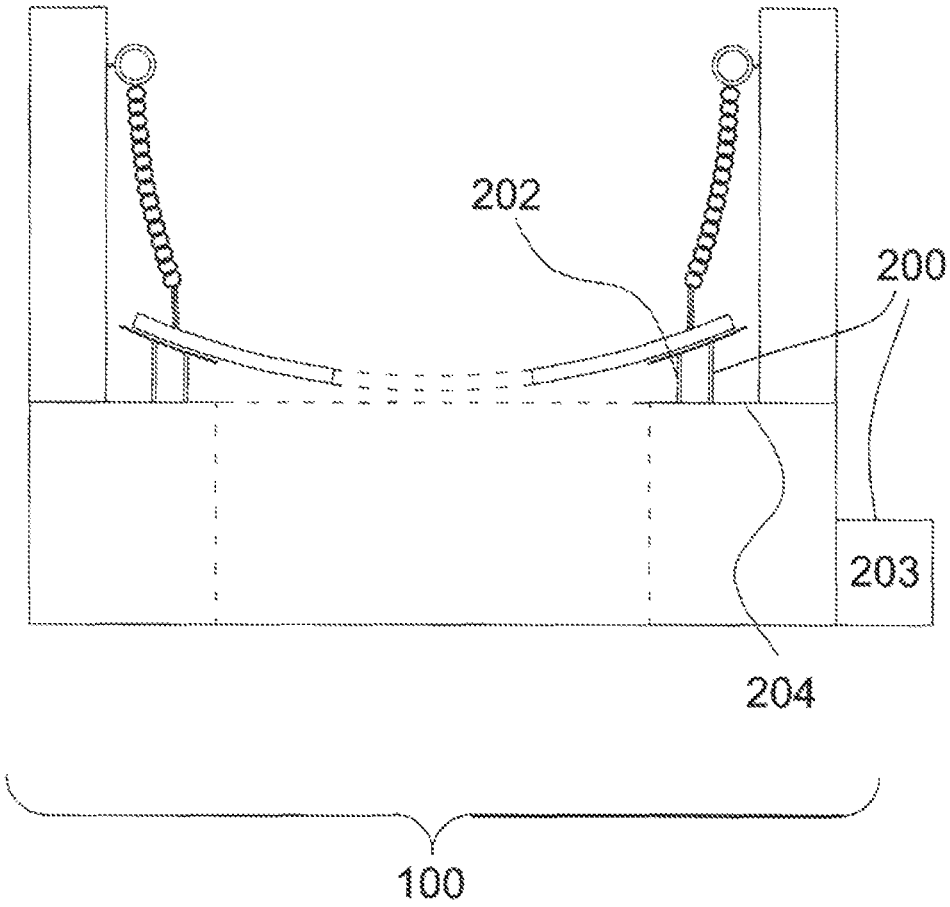
FIG. 1B and FIG. 1C are side views of the medical device showing the electronic lift system.
Figure 1C:
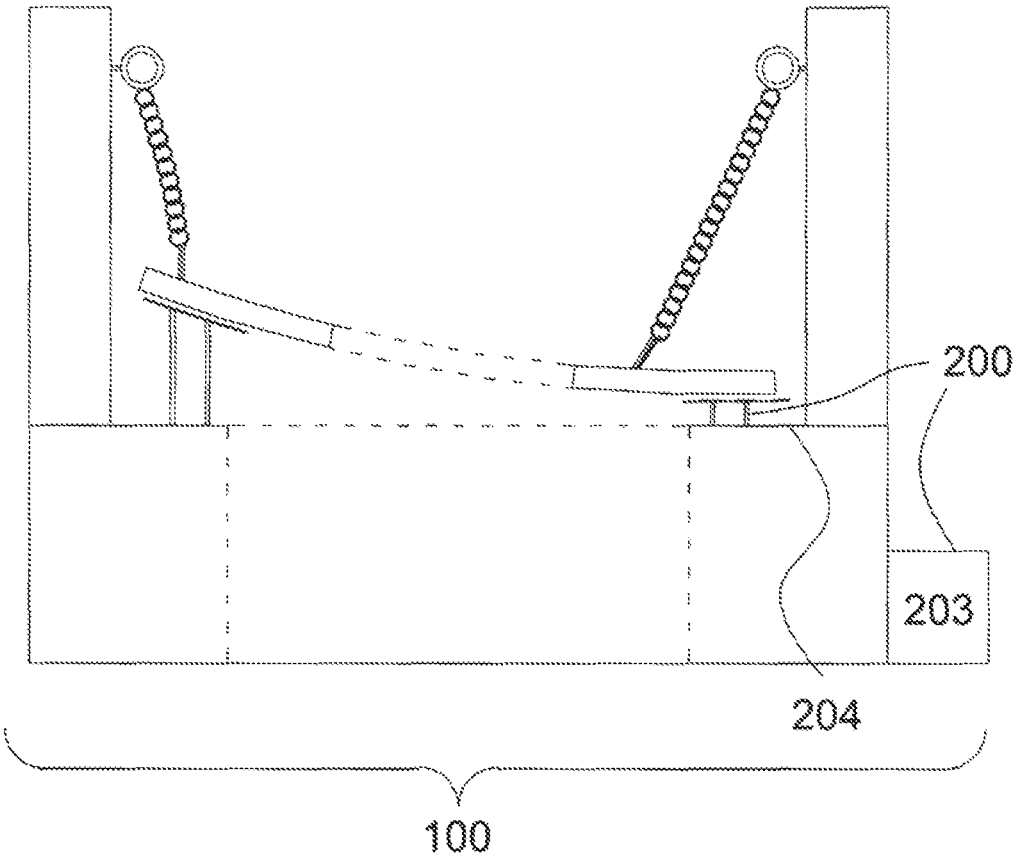

Referring to FIG. 1B and FIG. 1C, there is disclosed a side view of the rotating and waste elimination system 100.

An electronic lift system 200 seen in FIG. 1B and FIG. 1C supporting movement of the platform, comprising two pairs of posts 202, the top part of each individual post 202 is connected to the bottom of the platform and the bottom part of each post is connected to the top sides 204 of the rectangular base at approximately 10" distance from each of the short edges of the rectangular base 51 and platform 25, respectively; the lift system 200 has an programmable electronically-controlled gear 203 that operates the posts to cause one pair of posts to raise one end and simultaneously causes the second pair of posts to lower the opposite end of the platform to gently turn the patient. The electronic lift system 200 having programmed circuitry to determine how much force to apply and can be programmed as to how often to turn the patient. Chains are an optional security measure on the electronic lift system and may be placed on both sides of the platform and repositioned manually by chain hook and loops. However, they should not be taut to allow for automatic programmed turning.

The lift system 200 can also be a non-electronic lift system that is moved by a crankshaft known in the arts.

Figure 2:
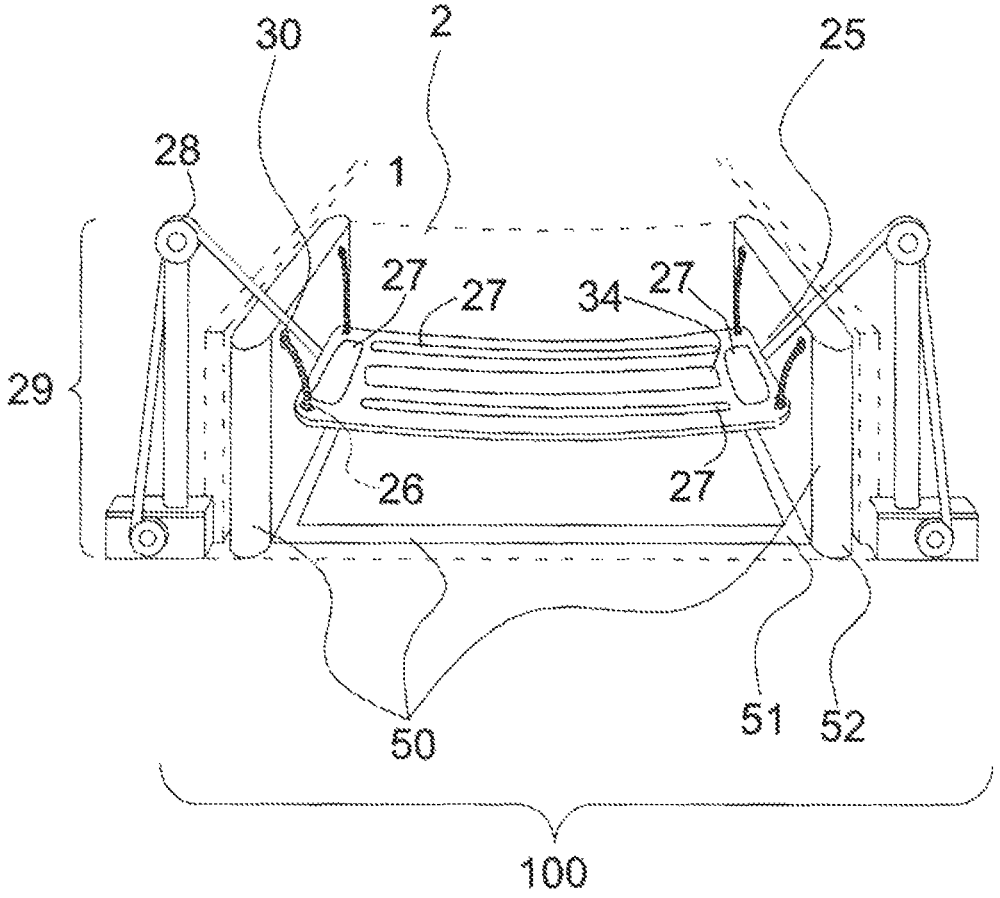
FIG. 2 is a perspective view of the medical device showing the two pulley systems.

Referring to FIG. 2, there is disclosed a perspective view of the rotating and waste elimination system 100. The rotating and waste elimination system 100 comprises three parts: 1) a frame 50, 2) a platform 25 and 3) two pulley systems.

The frame 50 has a rectangular base 51 that has four sides with the dimensions being approximately 36" long edges, 12" short edges, and has a central rectangular shaped cut out that has two long edges of approximately 32 inches and two short edges of approximately 8 inches. Additionally, the frame 50 has two side walls 52 of approximately 24 inches in height having an interior side, an exterior side, a top side, a bottom side, and two lateral sides with the bottom side perpendicularly attached to the 12" shorter edges of the rectangular base 51.

The platform 25 has a top side, a bottom side forming a four-sided rectangular shape with a dimension that has approximately 36" longer sides, 12" shorter sides, and a central cut out 34 having two long sides of approximately 32 inches and two short sides of approximately 8 inches. The platform 25 is positioned parallel above the base 51 and between the two 24" side walls 52, having one end of two chains 26 attached to each of the 12" shorter sides through a chain hook and loop 30 on the corners and the other end of the two chains 26 attached to each interior sides of the walls 52 near the top side through another set of chain hook and loops 30. The platform 25 is lined with additional mini-alternating air mattresses 27 all connected to the main alternating air mattress 1, the platform 25 having a plurality of fabric loops such as Velcro™ loops located on the bottom side.

An electronic pulley system 29 comprises a wheel on an axle that supports movement of a cable or belt 28 along its circumference. First end of the cable 28 is attached to the midpoint of each 12" shorter side of the platform 25 the second end of the cable 28 is attached to electronically controlled gears that rotate and counter-rotate to pull or release the cable 28 and in turn pull on or release the platform 25, the electronic pulley system 29 having programmed circuitry to determine how much force to apply and can be programmed as to how often to turn the patient. Said chains on both sides of the platform may be repositioned manually by chain hook and loops after the patient has been rotated to a new position to secure the patient. The chains are a security measure to prevent accidental falls and are not to be taut, so as to allow for automatic/programmed turning.

The pulley system can also be a non-electronic pulley system that is moved by a crankshaft known in the arts.

Figure 3:
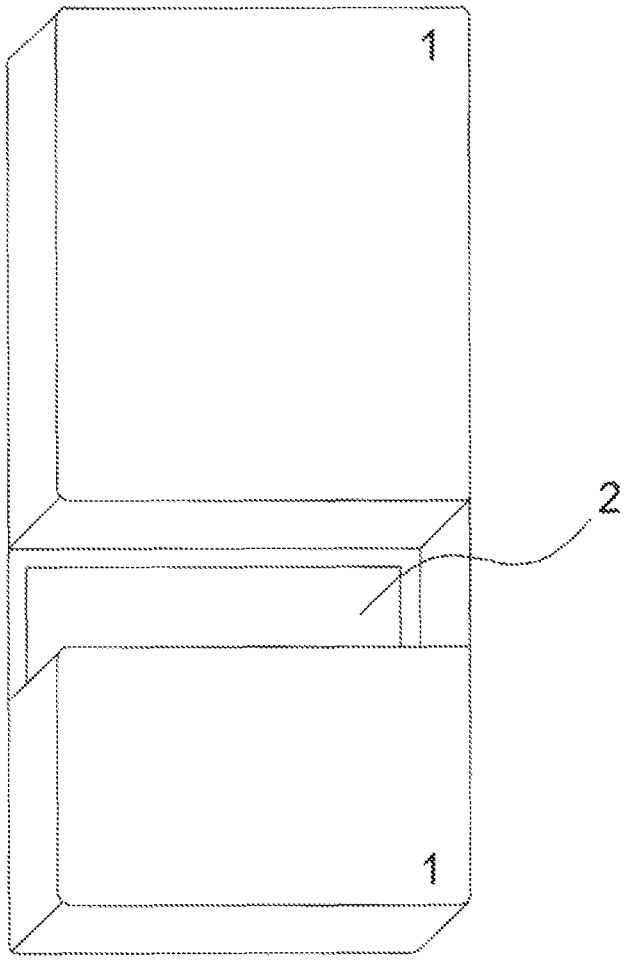
FIG. 3 is a top view of the mattress.
Figure 4:
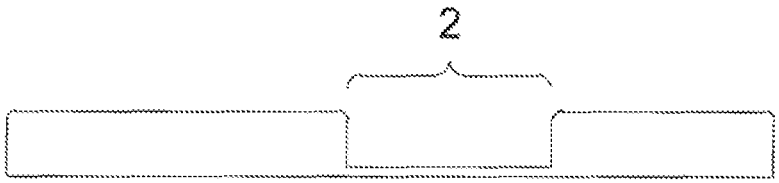
FIG. 4 is a side view of the mattress.
Figure 5:
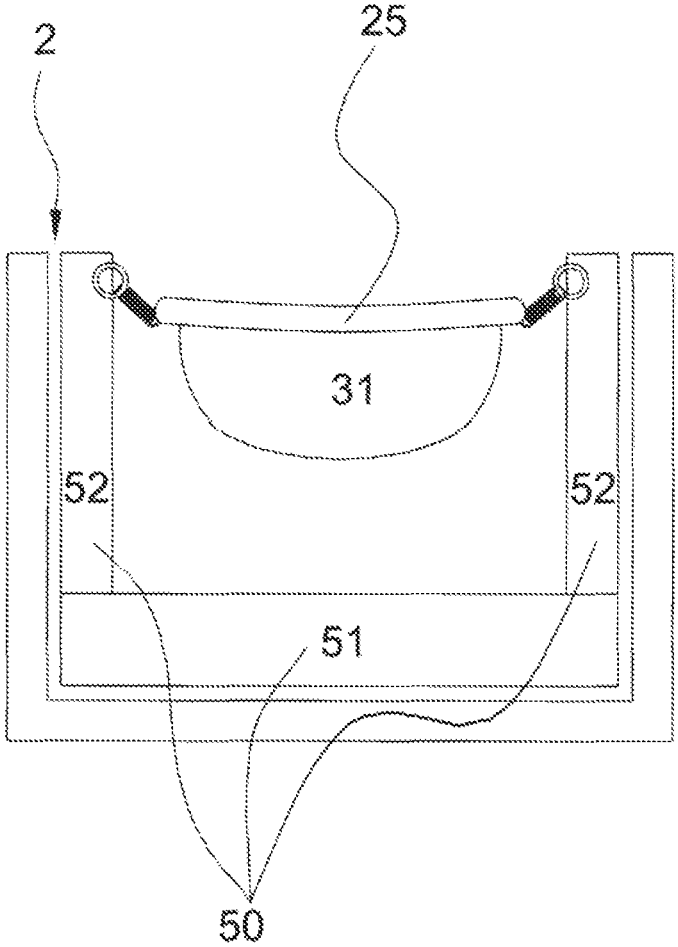
FIG. 5 is a side view of the frame and platform with plastic bag inserted for waste elimination, placed in the mattress's recess.

FIGS. 3 and 4 are a top view and a side view of the mattress 1 with a recessed area 2 for receiving the frame 50 and the platform 25. FIG. 5 is a side view of the platform 25, frame 50 and plastic bag 31 for waste elimination placed in the mattress's recess 2.

Figure 6:
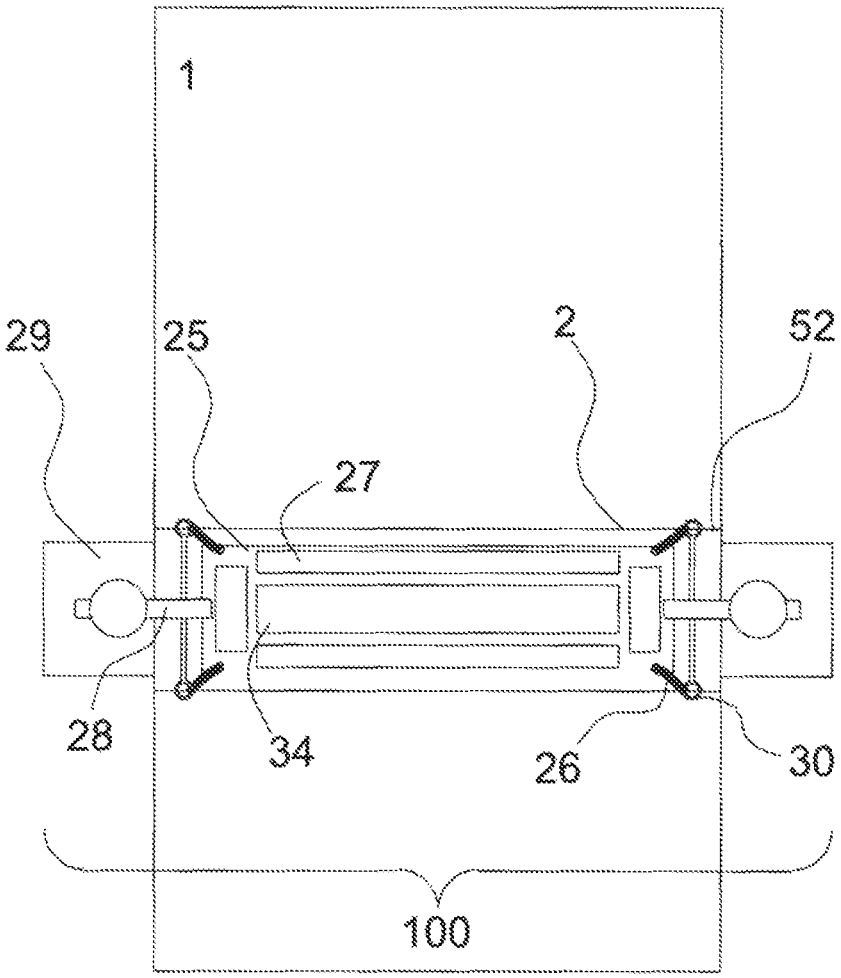
FIG. 6 is a top view of the medical device with the two pulley systems placed into the recess of the mattress.

Referring to FIG. 6, there is disclosed a top view of the mattress with a Rotation/Waste Elimination System 100 with the frame 50 and the platform 25 placed into the recess 2 of the mattress 1. When the frame 50 and platform 25 are placed within the recessed area 2, there is a continuous surface from the mattress 1 to the mini mattresses 27 on the platform.

In the preferred embodiment, the mattress 1 is an alternating pressure mattress known in the art. An alternating pressure mattress comprising a plurality of inflatable side formations, located on both sides of the mattress, which can be inflated and deflated cyclically in a predetermined sequence. In a second embodiment, the mattress is a regular mattress with a recess area with the mini-mattresses made of similar material or foam.

In the first and second embodiment, the electronic lift system or electronic pulley system rotates the lower half of the patient; the upper body may or may not have to be moved manually as determined by the degree of rotation. This allows for a more cost effective/economically feasible rotation/waste disposal system for lower-income nursing homes and caretakers in-home.

In a third embodiment the mattress is a lateral rotation therapy mattress with a hole around the patient's pelvic area for waste disposal. The lateral rotation therapy mattress is known in the art. (See U.S. Pat. No. 5,375,273, "Lateral rotation therapy mattress system and method", publication date Dec. 27, 1994, the disclosure of which is incorporated herein by reference). The lateral rotation therapy mattress includes: a plurality of side-by-side longitudinal air cells; and apparatus to supply pressurized air to the air cells to control the levels of pressure in individual ones of and/or groups of the air cells. The lateral rotation therapy mattress may have air cells divided into four groups: 1) left outer, 2) left inner, 3) right inner, and 4) right outer. Each air cell may be constructed of any suitable material such as compliant vinyl or urethane infused Nylon material. As an example, a patient may be laterally rotated about 30-45 degrees to the right by reducing the pressure in the right inner cells and increasing the pressure in the left inner cells. When it is desired to rotate the patient back to a supine position, the pressure in the right inner air cells are increased while the pressure in the left inner air cells are decreased until the pressure of both the right inner air cells and the left inner air cells are the same. When it is desired to rotate the patient to the left, the pressure in the right inner air cells are increased while the pressure in the left inner air cells are decreased. The rate of rotation is very slow and gentle so as not to wake the patient. The pressure control system for air support structure includes an air blower which supplies pressurized air to a main manifold which, in turn, provides air to air cells through a pressure regulator.

Figure 7:
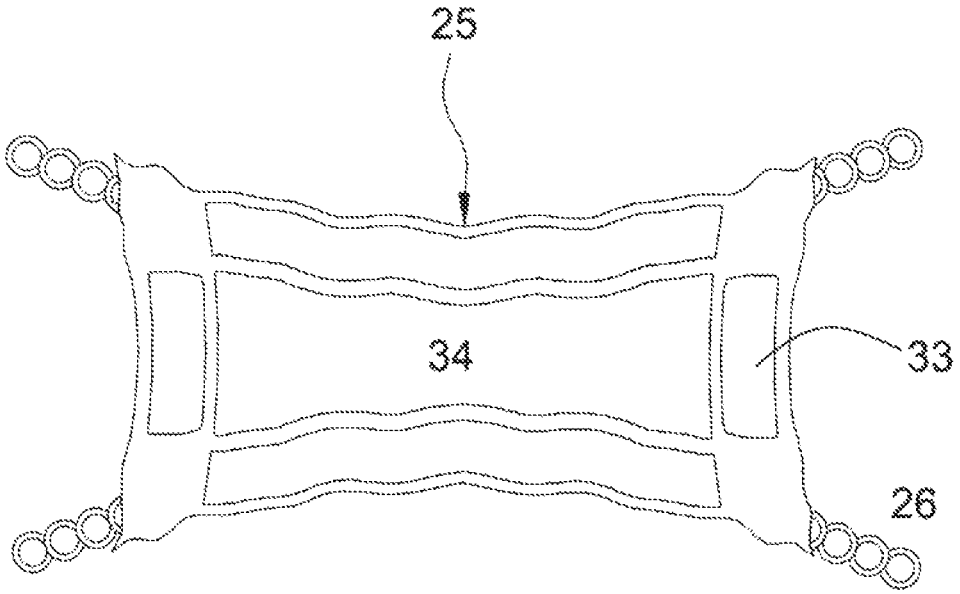
FIG. 7 is a bottom view of the platform showing fabric loops attached to each of the 4 sides and the cut-out portion of the platform, in which the waste collecting plastic bag will be placed.

Referring to FIG. 7, there is shown the bottom view of the platform 25 showing fabric loops 33 attached to each of the bottom 4 sides and the cut-out portion of the platform 34, in which the waste collecting plastic bag 31 will be placed.

Figure 8:
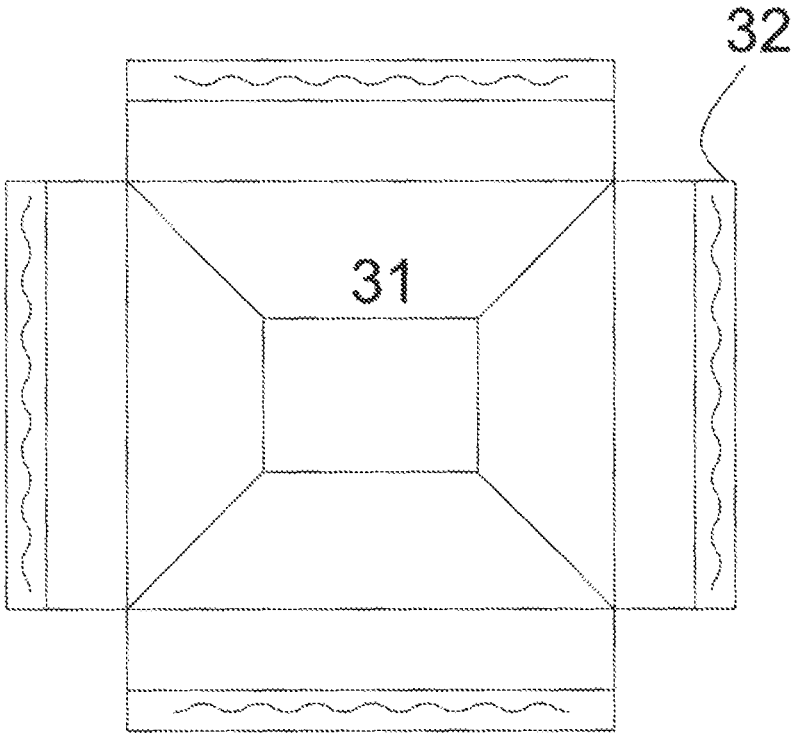
FIG. 8 is a perspective of the one-time use waste collecting plastic bag. Fabric loops are attached to the outside of the top of each of the 4 flaps.

FIG. 8 shows the one-time use waste collecting plastic bag having dimensions which should be an exact fit to the interior cut out 34 portion of the platform 25, with each corner cut down approximately 4" (or more) at the crease to separate the sides, fabric hooks 32 are located on the top 2" of the outside of each side of the plastic bag 31, the plastic bag 31 is inserted into the interior cut out 34 portion of the platform 25 with the plastic bag 31 sides folded over the mini air mattresses 27 and then having the top 2" of the outside of each side of the plastic bag 31 folded underneath so the fabric hooks 32 on the plastic bag 31 can engage with the fabric loops 33 located on the bottom of the platform 25. The one-time use waste collecting plastic bag 31 is inexpensive to manufacture and cost effective. The waste collecting plastic bag 31 can be easily removed and disposed by detaching its fabric hook from the fabric loop located on the bottom of the platform.

Figure 9:
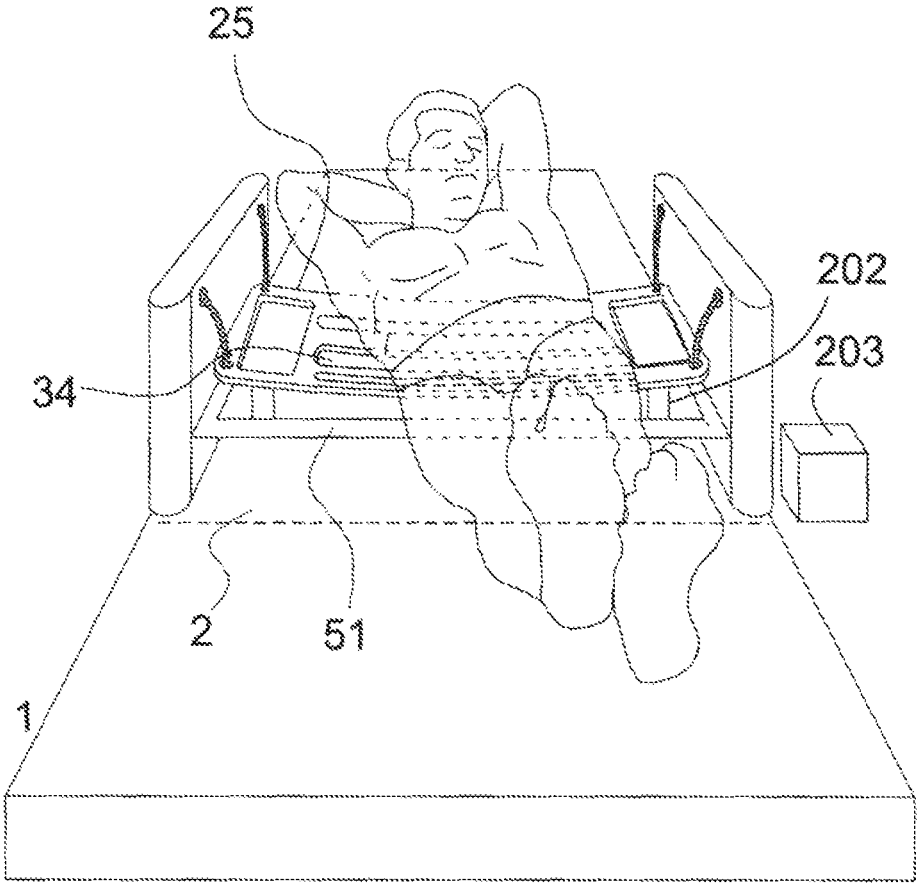
FIG. 9 is a perspective view showing the platform and electronic lift system with the patient tilted between 30 degrees to 40 degrees.

FIG. 9 shows the platform and patient tilted between 30 degrees to 40 degrees. A method for ease of rotation and waste disposal for bedridden patients to prevent and treat bedsores comprises steps of: (a) providing a mattress with a rotation/waste elimination system around the pelvic area of a patient. The mattress mentioned here is the mattress described earlier; (b) an electronic lift system supported by two pairs of sliding posts which raise one end and simultaneously lowers the opposite end of the platform to the right (or left) and turns the patient's body towards the left (or right); (c) if chains are used, manually repositioning the chain hook and loop to ensure the patient is secure, but confirming they are not taut to allow for automatic programmed turning; and (d) if necessary, manually turning the patient's upper body towards the left (or right).

Figure 10:
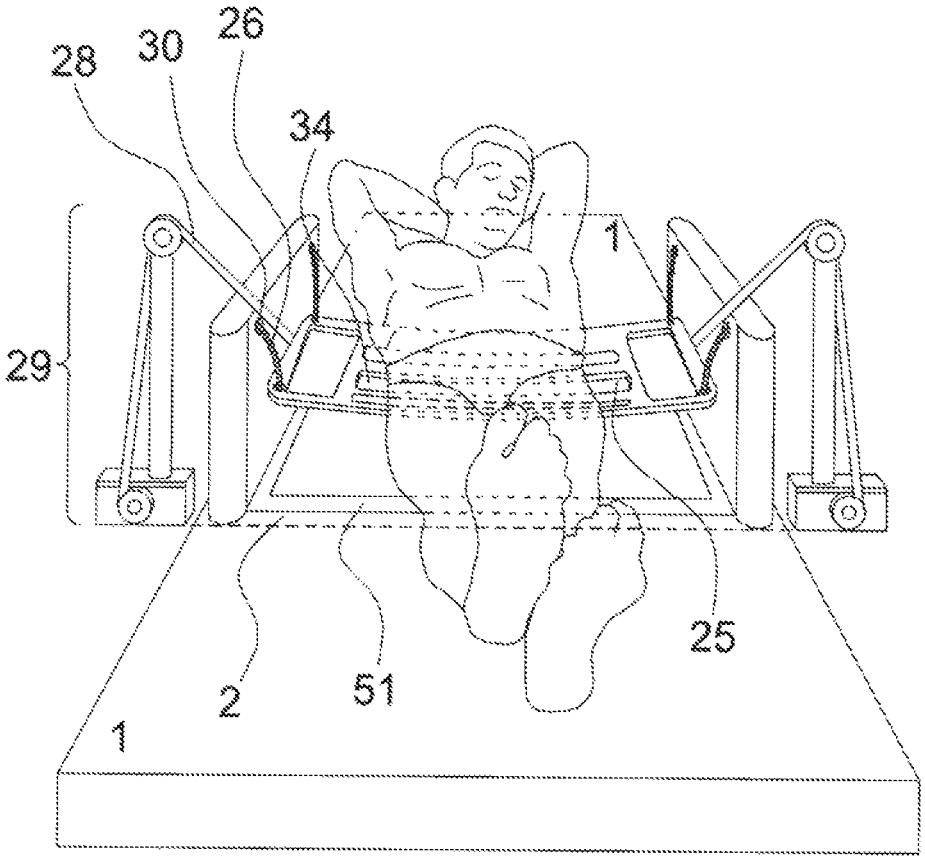
FIG. 10 is a perspective view showing the platform and two pulley systems with the patient tilted between 30 degrees to 40 degrees.

FIG. 10 shows the platform and patient tilted between 30 degrees to 40 degrees. A method for ease of rotation and waste disposal for bedridden patients to prevent and treat bedsores comprises steps of: (a) providing a mattress with a rotation/waste elimination system around the pelvic area of a patient.

The mattress mentioned here is the mattress described earlier; (b) an electronic pulley system to pull the right cable (or left cable), in turn pulling the right (or left) side of the platform up to the right (or left) and turning the patient's body towards the left (or right); (c) manually repositioning the chains' hooks and loops to ensure the patient is secure, but confirming the chains are not taut to allow for automatic programmed turning; and (d) if necessary, manually turning the patient's upper body towards the left (or right).

While the fundamental novel features of the invention as applied to the preferred embodiments have been depicted and described, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are entitled.

What is claimed is:

1. A user support, rotation and waste elimination system comprising:

a mattress having a width and a length, a head end and a foot end, and a recessed area or cavity located in a central region of the mattress and configured to be used at a user's pelvic region;

a frame disposed adjacent left and right long sides of the mattress;

a pelvic support member suspended from said frame so as to extend over the recessed area or cavity of the mattress for support of the user's pelvic region, said pelvic support member having an aperture, said pelvic support member having a width being substantially equal to the width of the mattress, and a length being approximately one third of the width of the pelvic support member oriented along a longitudinal axis of the mattress, and being located substantially equidistant from the foot end and the head end of the mattress;

a tilting mechanism operatively connected to said pelvic support member and configured to rotate or tilt the user's pelvic region; and a receptacle removably attached to said pelvic support member and disposed in part below said aperture for receiving eliminated waste of the user, said receptacle being located within said recessed area or cavity of the mattress.

2. The system of claim 1 wherein said tilting mechanism is operatively connected to said pelvic support member so as to selectively tilt said pelvic support member from side to side, about an axis parallel to a longitudinal axis of the mattress.

3. The system of claim 2 wherein said tilting mechanism includes a plurality of posts connected to said pelvic support member, at least one of said posts being movable alternately upwardly and downwardly so as to tilt said pelvic support member alternately to opposites sides of the system.

4. The system of claim 2 wherein said tilting mechanism includes a plurality of pulley systems connected to said pelvic support member, said pulleys being separately operable to shift opposing edges of said pelvic support member in opposite directions.

5. The system of claim 2 wherein said tilting mechanism includes an electronic control unit.

6. The system of claim 1 wherein said pelvic support member is provided with a plurality of mini-mattresses disposed along said aperture.

7. The system of claim 1 wherein said receptacle carries a plurality of fasteners for removably attaching said receptacle to said pelvic support member.

8. The system of claim 7 wherein additional fasteners are located on pelvic support member.

9. The system of claim 7 wherein said fasteners are taken from the group consisting of hook and loop fasteners.

10. The system of claim 1, further comprising a plurality of suspension members each connected on one side to said pelvic support member and on an opposite side to said frame.

11. The system of claim 10 wherein said suspension members are chain links.

12. The system of claim 1 wherein said receptacle is a bag.

13. The system of claim 12, wherein said bag is dimensioned to fit said aperture, said bag having corners cut to separate adjacent sides of said bag, said sides folded over a portion of said pelvic support member and underneath said pelvic support member, said bag having first fasteners engaging with second fasteners.

14. The system of claim 1 wherein said recessed area or cavity is an elongated cavity extending transversely to said mattress.

15. The system of claim 14 wherein said recessed area or cavity extends across the entirety of said mattress from the left long side to the right long side of the mattress.

16. A method for managing human waste collection and disposal for a bed-ridden user, comprising:

providing a mattress having a width and a length, a head end and a foot end, and a recessed area or cavity located in a central region of the mattress and configured to be used at a user's pelvic region;

providing a pelvic support member having a width being substantially equal to the width of the mattress, and a length being approximately one third of the width of the pelvic support member oriented along a longitudinal axis of the mattress, and being located substantially equidistant from the foot end and the head end of the mattress suspended at least in part over said recess in a said mattress, said pelvic support member having a central aperture;

providing a bag dimensioned to fit said aperture, said bag having a plurality of flanges or flaps on different sides of said bag, said flanges or flaps being provided with first fasteners;

attaching said bag to said pelvic support member so that a pocket or receptacle portion of said bag is disposed in said recess and below said aperture, the attaching of said bag to said pelvic support member including folding said flanges or flaps over and around a portion of said pelvic support member so that terminal portions of said flanges or flaps are located underneath said pelvic support member, the attaching of said bag to said pelvic support member further including coupling said first fasteners to second fasteners.

17. The method defined in claim 16, further comprising removing said bag from said pelvic support member upon a deposition of human waste into said receptacle portion of said bag, the removing of said bag including uncoupling said first fasteners from said second fasteners and unfolding said flanges or flaps from said portion of said pelvic support member.

* * * * *